United States Patent [19]

Nusbaum

[11] Patent Number: 4,856,615

[45] Date of Patent: Aug. 15, 1989

[54] SAFETY NET ARRANGEMENT FOR MULTI-FLOOR BUILDINGS UNDER CONSTRUCTION, AND METHOD

[76] Inventor: Arthur Nusbaum, 1500 Palisade Ave., Fort Lee, N.J. 07024

[21] Appl. No.: 247,044

[22] Filed: Sep. 20, 1988

[51] Int. Cl.[4] ..... E04G 21/32

[52] U.S. Cl. ..... 182/82; 182/138; 182/142

[58] Field of Search ..... 182/138, 139, 82, 142, 182/145, 146

[56] References Cited

U.S. PATENT DOCUMENTS

| | | | |
|---|---|---|---|
| 866,078 | 9/1907 | Sims | 182/82 |
| 2,142,651 | 1/1939 | Michelson | 182/82 |
| 3,533,487 | 10/1970 | Norin | 182/19 |
| 3,595,510 | 7/1971 | Hutchinson | 182/82 |
| 3,610,368 | 10/1971 | Johnson | 182/146 |
| 3,949,834 | 4/1976 | Nusbaum | 182/138 |
| 4,119,176 | 10/1978 | Verdu | 182/138 |
| 4,129,197 | 12/1978 | Preston | 182/82 |
| 4,171,033 | 10/1979 | Rust | 182/145 |
| 4,732,234 | 3/1988 | Brickman | 182/138 |

*Primary Examiner*—Reinaldo P. Machado
*Attorney, Agent, or Firm*—Kirschstein, Ottinger, Israel & Schiffmiller

[57] ABSTRACT

A safety net arrangement for and a method of protecting workmen and passersby from injury during the construction of a multi-floor building includes the raising and lowering of a fully deployed safety net along a plurality of upright guide rails attached to the building.

20 Claims, 5 Drawing Sheets

FIG. 4
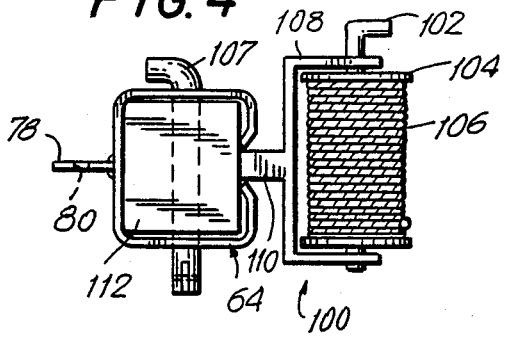
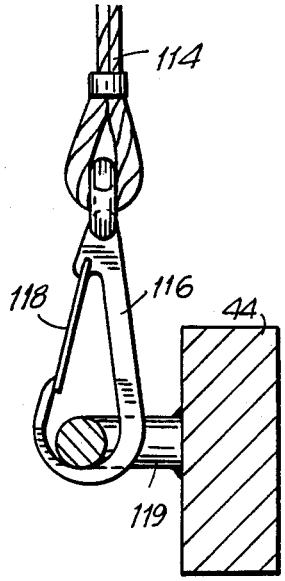
FIG. 5
FIG. 6
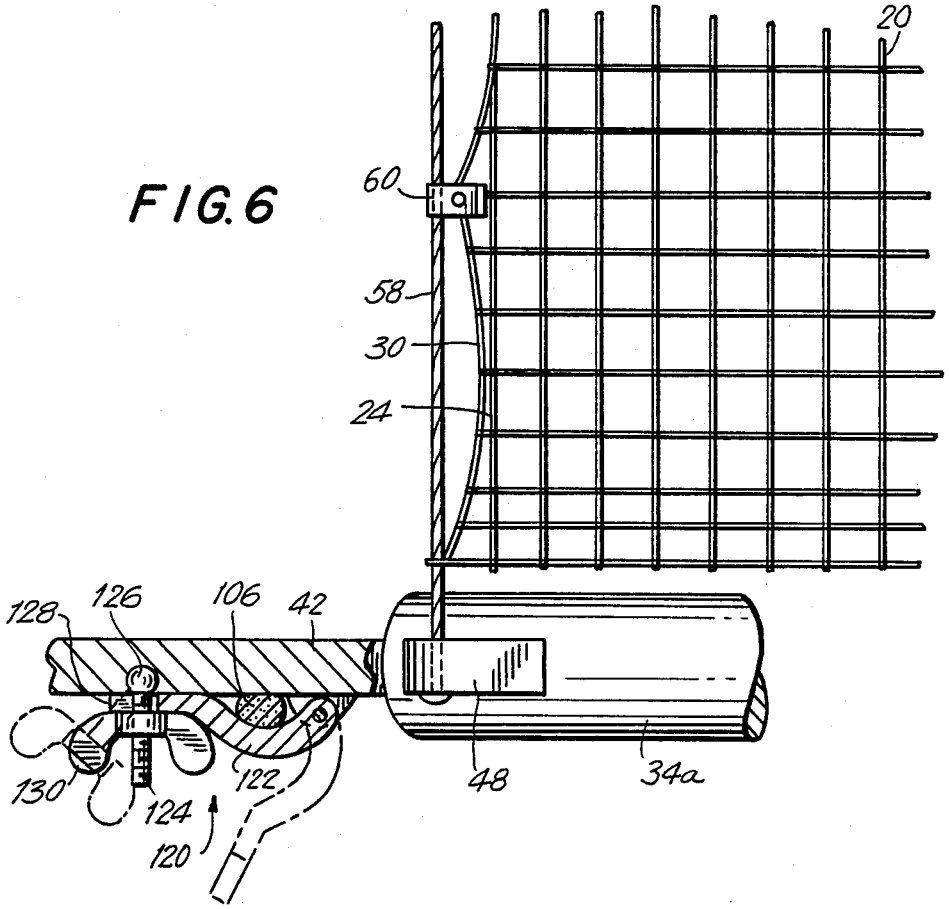

FIG. 8
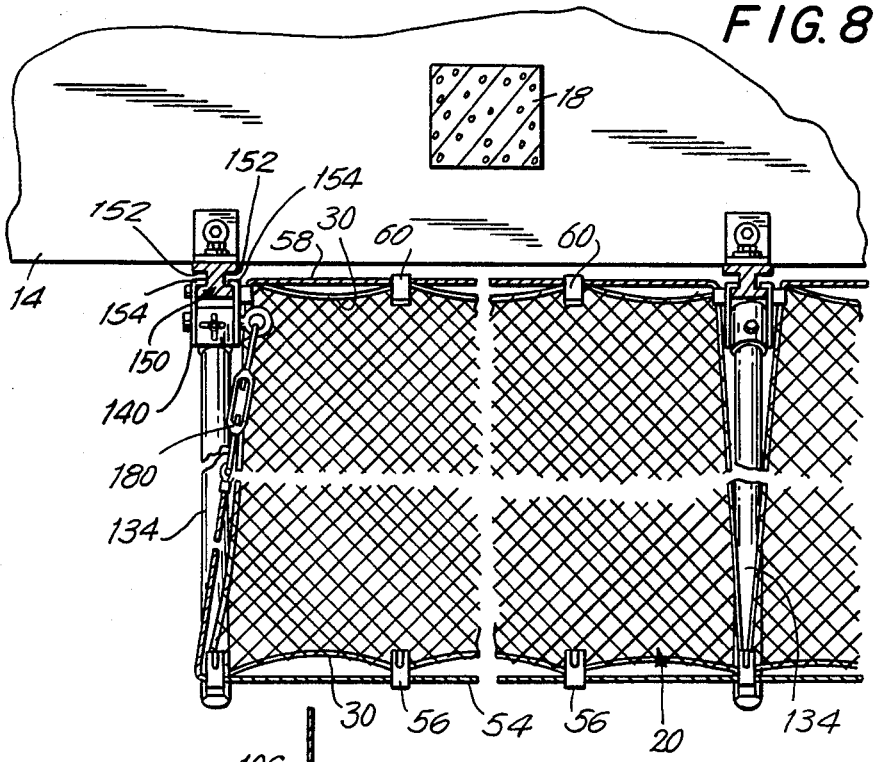
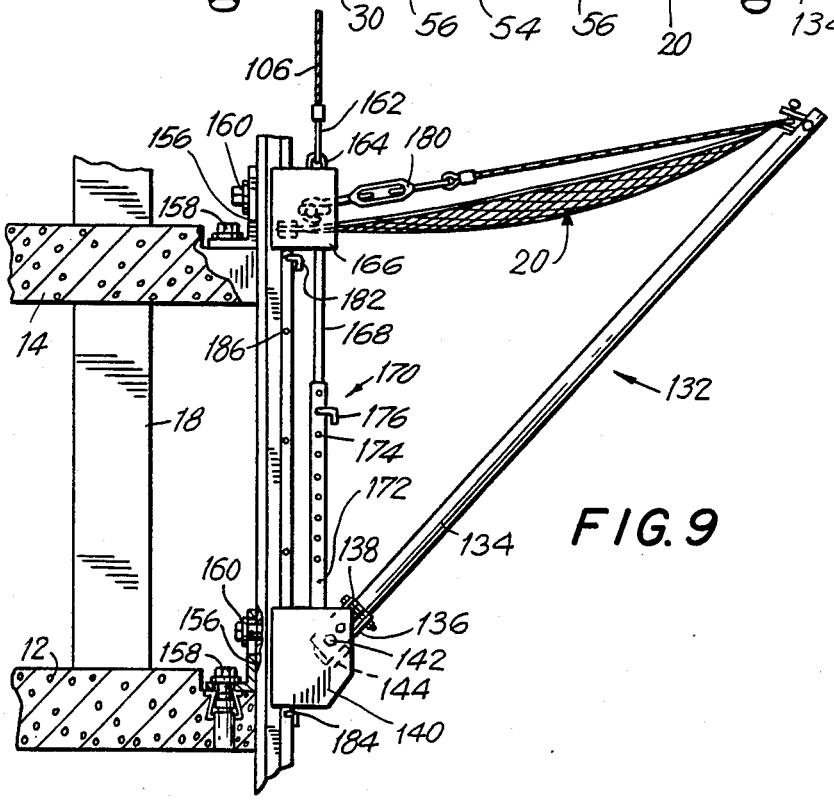
FIG. 9

SAFETY NET ARRANGEMENT FOR MULTI-FLOOR BUILDINGS UNDER CONSTRUCTION, AND METHOD

BACKGROUND OF THE INVENTION

1. Field of the Invention

This invention generally relates to a safety net arrangement for, and a method of, protecting workmen and passersby from injury during construction of multi-floor buildings and, more particularly, for raising or lowering a safety net which remains fully deployed throughout such raising or lowering.

2. Description of Related Art

It was known from my U.S. Pat. No. 3,949,834 to erect safety nets extending outwardly of the edges of the floors of a building under construction in order to protect workmen falling off a floor above the net and/or to protect passersby at ground level or workmen at lower levels from being injured by falling equipment, objects or, for that matter, from falling workmen. Each net had an outer edge supported by an outer end of a cantilevered support pole whose inner end was connected to a floor bracket bolted to a lower floor of the building. The inner edge of each net was likewise bolted to the next higher floor by eye-bolts or by cables tied to the nearest perimeter columns.

Although the safety net arrangement described in my patent has been used in many buildings under construction, it was not easily movable from lower to higher floors as building construction proceeded, since the net supports had to be unbolted from lower floors prior to being moved and re-bolted to higher floors. Disassembling a safety net during such unbolting and re-bolting exposed workmen and passersby to the very danger that the net was intended to prevent, i.e. arresting the fall of workmen and/or objects. Hence, some municipalities and some builders required that extra safety nets had to be erected while other higher nets were being removed. However, the use of redundant nets was not only expensive in terms of extra labor and parts, but was also time-consuming.

It was also known from U.S. Pat. No. 4,119,176 to "walk" a net up the outer face of a building by alternately folding and unfolding the net. The net of this latter patent was supported by a longer arm and a shorter arm arranged in a Y-shaped support structure at each side of the net. The arms had upper and lower inner ends mounted for up-and-down movement on and along upright guide rails that were bolted adjacent the outer face of the building. The arms were pivotably mounted to each other. In order to move the safety net either up or down, the arms had to be pivoted relative to each other, and the safety net was required to be folded inwardly toward the outer face of the building. After one or more of the arms were fixed in their new position relative to the guide rails, the safety net was thereupon unfolded outwardly away from the outer face of the building. While the net was folded, there was, however, no protection for workmen or passersby. Hence, redundant nets were recommended even for the safety net arrangement of this latter patent. Also, the folding and unfolding procedure was somewhat awkward and required a team of workmen to perform the procedure properly. This represented another extra expense, both in time and labor.

It was also known from U.S. Pat. No. 3,533,487 to utilize hoist cables for moving a scaffolding and safety net assembly upwardly and downwardly relative to a building. Also, U.S. Pat. No. 4,129,127 disclosed the sliding of a series of nets mounted in frames upwardly and downwardly along guide channels in upright beams anchored to a building under construction.

SUMMARY OF THE INVENTION

1. Objects of the Invention

It is a general object of this invention to overcome the aforementioned drawbacks of known prior art safety net arrangements.

It is another object of this invention to reliably protect workmen and/or passersby from injury at all times during the course of constructing a multi-floor building.

A further object of this invention is to reliably raise or lower a fully deployed safety net while maintaining the net fully deployed at all times during such raising or lowering.

Still another object of this invention is to eliminate the use of redundant nets with their concomitant extra expense.

Yet another object of this invention is to lessen the overall building costs, both in labor and time, while at the same time not sacrificing the safety of workmen and/or passersby.

2. Features of the Invention

In keeping with these objects, and others which will become apparent hereinafter, one feature of this invention resides, briefly stated, in a safety arrangement for and a method of safeguarding workmen and passersby from injury during the construction of multi-floor buildings. The invention comprises attaching a plurality of upright elongated guide rails to a building adjacent an outer face thereof. Support means are provided for suspending a safety net in a fully deployed condition in which the safety net extends generally outwardly away from the outer face of the building over a predetermined distance. Means are provided for mounting the support means and the safety net on the guide rail for joint movement lengthwise therealong. In addition, moving means are provided for raising or lowering the support means and the safety net in the fully deployed condition along the guide rails while constantly maintaining the safety net in the fully deployed condition during such raising and lowering.

Hence, in accordance with this invention, workmen and/or passersby are reliably protected from injury from falling workmen and/or falling objects at all times, because the safety net is not disassembled, bolted and unbolted, or folded and unfolded. Redundant nets, with their concomitant extra expense, both in labor and time, no longer need be used.

In an advantageous embodiment of this invention, the moving means includes a winch removably mounted in an overhead position on a respective guide rail. The winch, which preferably has a hand crank, but which also may be motor driven, has a depending cable which has a lower cable end which is operatively connected to the mounting means. The mounting means has a higher and a lower movable member mounted in a respective guide rail for joint movement lengthwise of the latter. The lower cable end may be detachably operatively connected to either the lower or the upper movable member. It is also advantageous if the winch cable is detachably operatively connected to both the higher and the lower movable members. In an alternative construction, a connecting arm of adjustable length may be connected between the higher and lower movable members.

In another advantageous embodiment, the support means and the safety net are locked at fixed elevations along the guide rails. Each guide rail has a longitudinal channel, and a plurality of holes are formed in each guide rail at spaced apart locations therealong. The mounting means includes a movable member received in a respective channel for movement therealong. A locking pin is insertable in a selected one of the holes below a respective movable member to fix the support means and the safety net at one of said fixed elevations.

In the same manner, the aforementioned winch has a winch member mounted for movement in the channel for movement lengthwise along a respective guide rail. A locking winch pin is insertable in a selected one of the aforementioned holes below the winch member to fix the winch at a desired elevation.

Another advantageous feature of this invention resides in elevating the safety net to a raised position above its support means in order to prevent injury to a falling workman or damage to a falling object that fall into the net. For this purpose, each safety net has an inner edge which is connected to an upright post to raise the elevation of the net.

The support means comprises a pair of support structures extending over said predetermined distance, each support structure holding the net at its inner and outer peripheral edges. Each support structure has at least one arm which normally extends generally outwardly away from the outer face of the building in the fully deployed condition of the net. This one arm is pivotably mounted on the mounting means for freedom of angular movement about a pivot axis back toward the outer face of the building in the event that a workman or object falls into the net. This feature provides a "softer" catch or landing and provides a further safety feature in that the tendency of workmen or objects to rebound from the net is lessened.

It is envisioned that a plurality of the aforementioned safety nets be deployed along one or more, if not all, of the sides of a building under construction. As construction proceeds, a single workman may go from winch to winch and turn each winch handle to raise its associated net support structure up by a selected amount, thereby gradually raising all of the nets in a simple manner. By turning each winch handle in reverse direction, the safety nets may be lowered. At all times, the safety net performs its function of protecting workmen and passersby from falling workmen or objects.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 4 is a top plan view taken on line 4—4 of FIG. 1 looking in the direction of the arrows;

FIG. 5 is an enlarged sectional view taken on line 5—5 of FIG. 3 looking in the direction of the arrows;

FIG. 6 is an enlarged sectional view taken on line 6—6 of FIG. 2 looking in the direction of the arrows;

FIG. 8 is a top plan view of the safety net arrangement of FIG. 7; and

FIG. 9 is an end view analogous to FIG. 2 of the embodiment of FIG. 7.

DETAILED DESCRIPTION OF THE PREFERRED EMBODIMENTS

Figure 1:
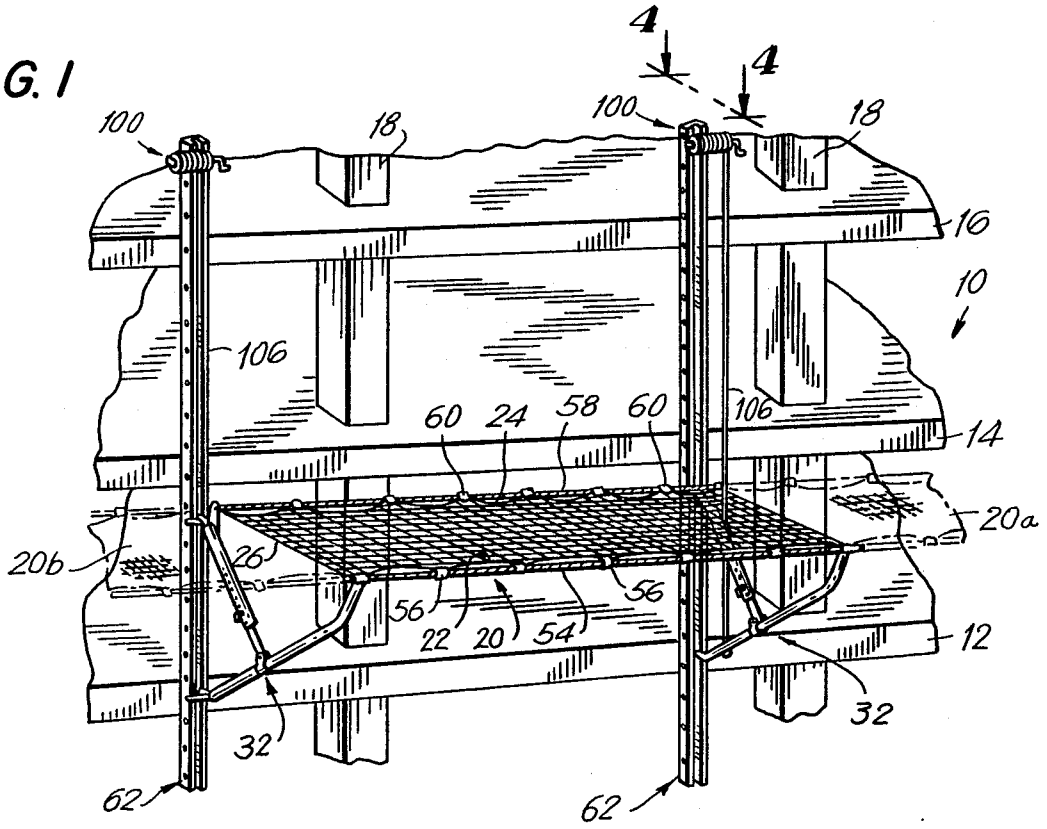
FIG. 1 is a front perspective view of one embodiment of a safety net arrangement in accordance with this invention, attached to a partly broken-away view of a multi-floor building under construction.
Figure 7:
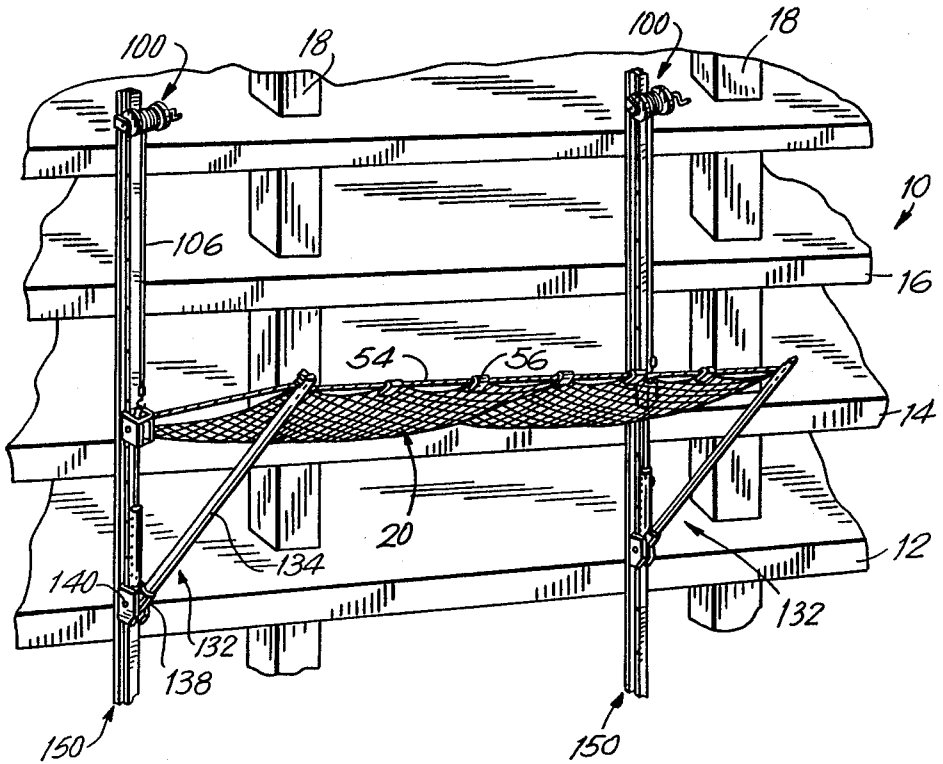
FIG. 7 is a view analogous to FIG. 1, but of another embodiment of the safety net arrangement in accordance with this invention.

Referring now to the drawings and, more particularly, to FIGS. 1 and 7 thereof, reference numeral 10 generally identifies a multi-floor building under construction. Building 10 has floors 12, 14 and 16 in ascending order, as well as building columns 18 shown in broken-away view. Only a portion of one side of building 10 has been shown in order to illustrate the invention. However, it will be expressly understood that this invention may be used in connection with buildings having many more than three floors and, of course, more than one side.

A safety net 20 is suspended adjacent an outer face of building 10. The net 20 comprises a net fabric having an outer edge 22 further from the external or outer face of the building, an inner edge 24 closer to the outer building face, and a pair of end edges 26, 28. Net 20 has a reinforced rope or cable edging 30 (best shown in FIG. 6) which extends peripherally along each edge 22, 24, 26, 28. In a preferred embodiment, net 20 has a generally rectangular configuration, and is about 25 ft. long and about 8–15 ft. in width.

Support means including a pair of support structures 32, 32 are located at opposite ends of the net underneath the end edges 26, 28. The support structures 32, 32 are operative for suspending the net 20 in a fully deployed condition in which, as shown in FIGS. 1 and 2, the net extends generally outwardly away from the outer face of the building in a generally horizontal plane relative to the ground over a predetermined distance or "reach".

Figure 2:
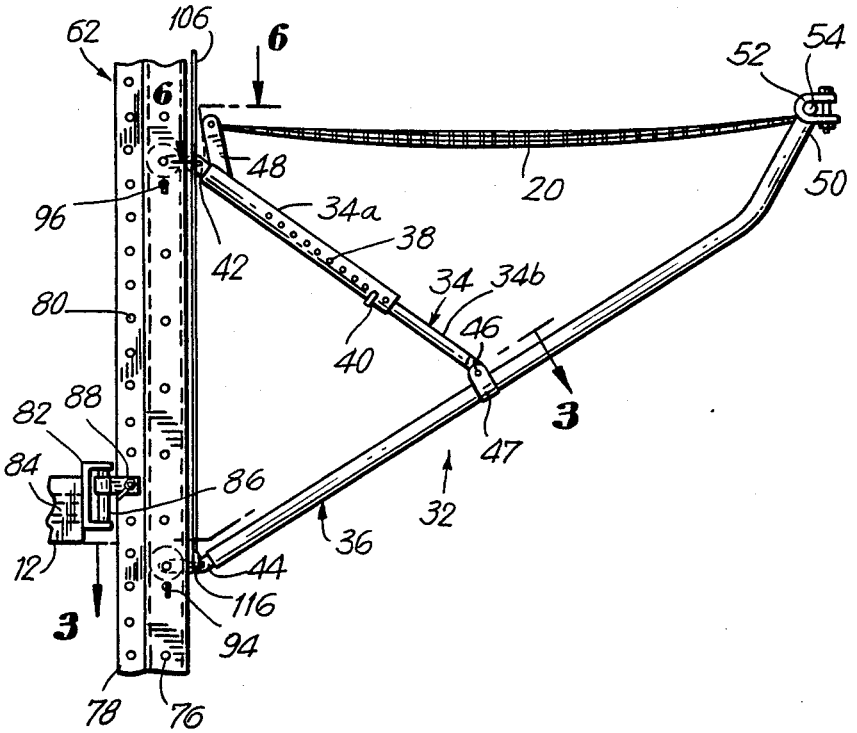
FIG. 2 is an enlarged end view of the safety net arrangement of FIG. 1.

As best shown in FIG. 2, each support structure 32 has a shorter arm 34 composed of a pair of telescoping sections **34*a*, 34*b*, as well as a longer arm section 36. The shorter and longer arms form a generally Y-shaped configuration. Telescoping section 34*a* is provided with a plurality of holes 38 spaced apart of one another along its length. Telescoping section 34*b* has a single hole which is juxtaposed with a selected one of the holes 38 in order to adjust the combined length of the shorter arm 34. A locking pin 40 is insertable through the juxtaposed holes in sections 34*a*, 34*b* to fix the length of the shorter arm 34** to a desired dimension.

Telescoping section **34*a* has an inner flanged end 42 located at a higher elevation than an inner flanged end 44 of the longer arm 36. Telescoping section 34*b* has an outer flanged end 46 which is pivotably connected to a joint 47 that is fixed to a middle region of the longer arm 36. An upright post 48 is welded on, and extends generally upwardly and slightly rearwardly of, telescoping section 34*a*. The longer arm 36 has an outer end region 50 which carries a screw shackle 52 for engaging a cable 54 which runs along the outer edge 22 of the net 20** in a direction which is generally parallel to the cable edging 30 at the outer net edge 22. Cable clamps 56 (see FIG. 1) connect the cable 54 to the cable edging 30 at spaced-apart locations along the outer net edge 22.

Another cable 58 (see FIGS. 1 or 6) runs along the inner edge 24 of the net and in a direction that is generally parallel to the cable edging 30 located at the inner edge 24. Cable 58 is strung tautly between the upright posts 48 of two adjacent support structures 32. Similarly, the aforementioned cable 54 is tautly strung between the outer end regions 50 of two adjacent support structures 32. The cable edging 30 at the inner net edge 24 is connected by additional clamps 60 to the cable 58.

As best shown in FIG. 2, the net 20 is suspendably held at a raised elevation relative to the shorter arm 34 and the longer arm 36 of each support structure 32. Should a workman or object fall into the net and their weight push the ne down, then the workman is less likely to be injured and the object is less likely to be damaged by coming into contact with the shorter and longer arms 34, 36 during initial or subsequent bounces. As previously mentioned, the adjustability in length of the shorter arm 34 together with the joint 47 permits the angle and reach of the net to be controlled and positioned as desired. In all adjusted positions of the shorter arm 34, the shorter and longer arms of each support structure are always located well below the net to protect workmen and objects falling thereon.

Figure 3:
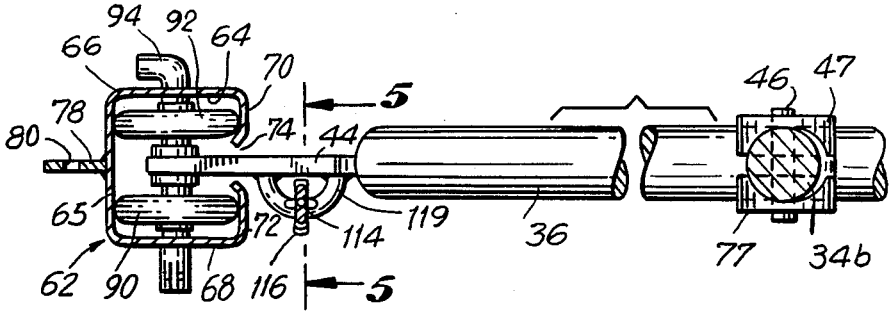
FIG. 3 is an enlarged sectional view taken on line 3—3 in the direction of the arrows of FIG. 2.

Returning to FIG. 1, a plurality of upright elongated guide rails 62 are attached to the building adjacent the outer face thereof. As best shown in FIG. 3, each rail 62 has an interior longitudinal channel 64 bounded by a base wall 65, side walls 66, 68 generally parallel to each other, and in-turned top walls 70, 72 which extend toward, but terminate short of, each other in a plane generally parallel to base wall 65. Top walls 70, 72 bound therebetween a front opening 74 through which the aforementioned inner flanged ends 42, 44 of arms 34, 36 extend into the channel 64.

Side walls 66, 68 are provided with a first plurality or column of juxtaposed pairs of holes 76 spaced apart of one another lengthwise of each rail 62. In addition, a rear web 78 extends rearwardly of the base wall 65 and is provided with a second plurality or column of holes 80 spaced apart of one another lengthwise of each rail 62.

In order to attach each guide rail to the outer face of the building 10, a U-shaped bracket 82, having a threaded stud 84 welded thereto and extending rearwardly therefrom, is provided for each floor, e.g. floor 12 in FIG. 2. An upright pivot 86 extends between upper and lower arms of bracket 82. The threaded stud 84 is embedded in the building structure, preferably threadedly engaging a complementary socket which is encased in concrete. A locking bolt 88 is inserted through a selected one of the holes 80 in order to attach the guide rail to floor 12.

Additional brackets 82, studs 84, pivots 86 and locking bolts 88 are provided for floors 14, 16, and are attached to the nearest hole 80 in the web 78. As work proceeds and additional floors are erected, either the first-mentioned rail 62 has a sufficient height to accommodate the raising and lowering of the net as described below, or additional rails identical to rail 62 can be erected in alignment with the aforementioned rail 62 in order to provide a continuous track along which the safety net may be raised and, conversely, lowered.

The support structures 32 and the net 20 are mounted on the guide rails 62 for joint movement lengthwise along the same by having each inner flanged end 42, 44 of arms 34, 36 mounted to a pair of rollers 90, 92 (see FIG. 3). Each pair of rollers is received in the channel 64, the rollers rollingly engaging on and along the base wall 65 and the top walls 70, 72 of a respective guide rail. In order to arrest the position of the support structures and the net at a desired elevation, the shaft of an L-shaped locking pin 94 is inserted through one of the aforementioned pair of juxtaposed holes 76 formed in the side walls 66, 68 of the associated guide rail immediately below the respective roller pair. The locking pin 94 acts as a stop and prevents the roller pair from descending under the influence of gravity the channel 64. Either one locking pin 94 can be inserted below the roller pair mounted on lower flanged end 44, or another locking pin 96 can be inserted below the roller pair mounted on upper flanged end 42, or, for increased safety, both locking pins 94, 96 can be used.

Each such locking pin serves to prevent downward movement. Upward movement is permitted since no pin bars the way. Rather than inserting each such locking pin below a respective roller pair, it is also contemplated to insert each locking pin through a bore extending through the shaft on which the rollers are turnably mounted. This invention is not intended to be limited to the use of a pair of rollers at each flanged end 42 44, since one roller, or, for that matter, any movable member that can be moved along each guide rail, may serve equally well.

The support structures and net are raised and/or lowered, in an advantageous embodiment, by a plurality of winches 100, each removably mounted on a respective rail 62 at an overhead location above the net. Each winch, as best shown in FIG. 4, has a crank handle 102, a spool 104 for carrying a cable 106, a bracket 108 for supporting the spool 104 at opposite ends thereof, a rear extension 110 welded to and extending rearwardly from the bracket 108, and a movable winch member or slide block 112 received in the channel 64 of a respective guide rail 62 for movement therealong.

By manually turning the handle 102 about a horizontal axis, the cable 106 is wound and unwound from the spool. The shaft of a generally L-shaped locking winch pin 107 is inserted through a selected pair of juxtaposed holes 76 on the side walls 66, 68 of a respective guide rail immediately below the slide block 112 to prevent the winch 100 from descending the guide rail.

The cable 106 depends from each winch and is connected, preferably in a detachable manner, to each support structure. For example, as shown in FIGS. 2, 3 and 5, the lowermost end 114 of the cable supports a spring clip 116 having a resilient catch 118. When the catch 118 is displaced, the clip 116 hookingly engages a generally U-shaped hasp 119 welded on the inner flanged end 44 of longer arm 36.

Higher up on the cable 106 in the vicinity of flanged end 42, a clamp 120, as best shown in FIGS. 2 and 6, clampingly engages the cable. Clamp 120 includes a hinged clamping member 122 mounted on flanged end 42 for pivoting movement toward and away from the same. A threaded pin 124 having a ball end 126 is captured in a spherical socket formed in the flanged end 42. The pin 124 can pivot freely about its socket. To clamp the cable 106, the clamping member 122 is pivoted toward the flanged end 42, and the pin 124 is pivoted so that it extends through a slot 128 formed in the clamping member 122. A threaded wing nut 130 is threaded onto the pin 124 and, when the nut is fully tightened, the clamping member 122 exerts a clamping force against the cable 106 and pushes the same against the flanged end 42. The clamp 120 is easily released by unthreading the wing nut 130 and pivoting the clamping member 122 to the position shown in phantom lines in FIG. 6.

As shown in FIG. 1, the net is shown in its fully deployed or extended condition in use in which the net is positioned to catch falling workmen and/or objects. Rather than bolting or untolting the net supports, or folding and unfolding the net, or tying and untying supporting cables, as was taught by known prior art safety net arrangements, the present invention proposes the raising or lowering of the net while it remains in its fully deployed condition during such raising or lowering.

To raise the fully deployed net, a worker can walk over to a first winch and turn its crank handle, thereby raising the support structure 32 connected to the cable associated with that winch. The end of the net which is supported by the raised support structure 32 jointly moves up with the same, for example, over a distance of a few feet. It will be remembered that the support structure and its attached net are always free to move upward. Thereupon, the workman can walk over to a second winch and turn its crank handle, thereby raising the opposite end of the net and the support structure thereof to the same elevation as was previously achieved by the first winch.

In another intended use, two workmen, each manning a separate winch, can turn the respective crank handles and raise the entire net and both support structures in a substantially simultaneous manner.

In still another approach, rather than using manually operated winches, each winch can be provided with a separate motorized drive, or two or more winches can be interconnected and simultaneously operated by a motorized power drive.

At any convenient point during the raising of the net, the aforementioned pins 94, 96 can be removed from their previous positions in holes 76, and re-inserted in other holes 76 located immediately below the pairs of rollers which have now been moved to a new elevation. The pins 94, 96 need not be moved each time another floor is erected, since the net is supported, at least in part, by the winches and, in any event, even if the winches fail, the total drop of the net and its support structures would not be down to ground level, but would only be as far as the previous positions at which the locking pins were placed.

Eventually, during the raising of the safety net and its support structures, the net approaches the level of the winches and, hence, it is desired to move the winches further up the building. As mentioned before, additional guide rails may be aligned with guide rail 62, if necessary, in order to extend the length thereof. By removing the aforementioned locking winch pin 107 and re-inserting the same at another pair of juxtaposed holes 76 on the guide rail at a higher elevation, the winch, which has now been moved to said higher elevation, may be conveniently secured thereat. The removability of the winch from the guide rail also enables each winch to be stowed at the end of each workday to prevent theft.

Returning to FIG. 1, this invention contemplates providing a plurality of the aforementioned nets 20 and arranging the same along an entire side and along all the sides of the building 10. Additional nets 20*a*, 20*b* are supportably held in approximately the same plane as net 20 in order to provide a continuous uninterrupted net to arrest falls. Rather than providing a separate support structure 32 at the end of each net, each support structure may conveniently support two adjacent end edges of neighboring nets. The aforementioned cables 56, 58 are tautly strung between and along such neighboring nets.

Turning now to the embodiment of FIGS. 7–9, like parts with those of the embodiment of FIGS. 1–6 have been identified wherever possible by like reference numerals in order to simplify the description. As before, a safety net 20 is supportably held in a fully deployed condition adjacent the outer face of building 10 by a pair of support structures 132. Rather than having two arms arranged in a Y-shaped configuration, each support structure 132 consists of a single cantilevered arm or extension pole 134 having an inner end 136 lockingly received in a mounting tube 138 which, in turn, is pivotably mounted on a support bracket 140 for movement about a pivot axis which extends lengthwise along pivot 142. A crosspiece 144 is welded on the bracket 140 and prevents the pole 134 from swinging downwardly past its position shown in FIG. 9. The pole 134, however, is free to move toward the face of the building, i.e. in a counterclockwise direction as considered in relation to FIG. 9, in order to provide a "softer" catch for falling workmen and/or objects.

Each guide rail 150 is also different in structure from that previously described. As best shown in FIG. 8, each guide rail has an H-shaped cross-section with open channels 152 facing away from each other at opposite sides of a respective rail. The bracket 140 has rear flanges or sliders 154 extending toward, but terminating short of, each other in a common plane. The sliders 154 are received in sliding engagement with a respective channel 152. As previously mentioned, each support structure 132 need not be moved along the rails 150 by rollers rolling along the rails, but can be moved by sliders sliding along the rails.

Each guide rail need not be attached to a floor in the manner previously described, but, in a preferred case, L-shaped brackets 156, each for a different floor, can be employed. Each bracket 156 has a horizontal flange secured by a threaded bolt 158 threaded into a complementary threaded part that is embedded in the concrete at the perimeter of the floor. Each bracket 156 also has a vertical flange having a hole through which a bolt 160 is threaded into a corresponding threaded hole formed at the rear of a respective guide rail.

As for the depending cable 106, its lowermost end can be secured to a hook 162 which hookingly engages a hasp 164 welded onto, and extending upwardly from, a holder 166. A connecting arm 170 comprised of a pair of telescoping sections 168, 172 extends between and is connected to the holder 166 and the bracket 140. Section 172 is advantageously provided with a plurality of holes 174 arranged along its length. Section 168 is also provided with a hole and, when the latter is juxtaposed with a selected one of the holes 174, the combined length of the sections 168, 172 can be fixed by insertion of a locking pin 176 into the juxtaposed holes.

In addition, outer cable 54 is connected at each of its opposite ends to a turnbuckle 180 which, in turn, is connected to the holder 166 in order to adjust the tension of the net. 20.

As before, a plurality of nets can be arranged in endwise relationship with net 20 in order to provide for a continuous fall-arresting structure.

As in the previous embodiment, a locking pin 182 and a locking pin 184 may be inserted in holes 186 immediately below the holder 166 and the bracket 140, respectively. The locking pins 182, 184 serve to prevent the net 20 and its support structures from descending the rail 150. The holes 186 are spaced apart of one another along the rail 150.

In use, the net 20 and its support structures 132 are raised in the same manner as that described earlier for the embodiment of FIGS. 1–6. Conversely, by reversing the raising procedure, the net and its support structures can be lowered.

It will be understood that each of the elements described above, or two or more together, also may find a useful application in other types of constructions differing from the types described above.

While the invention has been illustrated and described as embodied in a safety net arrangement for multi-floor buildings under construction and method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A safety arrangement for multi-floor floor buildings under construction, comprising:

(a) a plurality of upright elongated guide rails attached to a building adjacent an outer face of the building;

(b) a safety net having opposite end regions;

(c) support means including a pair of support structures, each supporting a respective end region of the safety net, for suspending the safety net in a fully deployed condition in which the safety net extends generally outwardly away from the outer face of the building over a predetermined distance;

(d) means for mounting the support structures on the guide rails for independent movement lengthwise along the guide rails; and (e) moving means for moving the support structures independently of each other and in alternate succession to different elevations along the guide rails while constantly maintaining the safety net in the fully deployed condition during each movement.

2. The safety arrangement as recited in claim 1, wherein said moving means includes means for locking the support means and the safety net at fixed elevations along the guide rails.

3. The safety arrangement as recited in claim 2, wherein each guide rail has a longitudinal channel, and wherein said mounting means includes a movable member received in a respective channel for movement along the respective channel; and wherein the locking means includes a plurality of holes spaced apart of one another along each guide rail, and a locking pin insertable in a selected one of the holes below a respective movable member to fix the support means and safety net at one of said fixed elevations.

4. The safety arrangement as recited in claim 3, wherein each movable member constitutes at least one roller in rolling engagement with a respective channel.

5. The safety arrangement as recited in claim 3, wherein each movable member constitutes at least one slide in sliding engagement with a respective channel.

6. The safety arrangement as recited in claim 1, wherein the safety net has inner and outer peripheral edges, and wherein the support structures extend over said predetermined distance, said support structures being connected to the inner and outer peripheral edges between which the safety net is suspended.

7. The safety arrangement as recited in claim 6, wherein the support means holds the net at its inner and outer peripheral edges at a raised elevation above the support structures.

8. The safety arrangement as recited in claim 6, wherein each support structure has a single cantilever arm having a free end connected to the outer peripheral edge of the net.

9. The safety arrangement as recited in claim 6, wherein each support structure has a shorter and a longer arm arranged in a generally Y-shaped configuration, each longer arm having a free end connected to the outer peripheral edge of the net.

10. The safety arrangement as recited in claim 6, wherein each support structure has at least one adjustable arm comprised of a pair of telescoping members, one of the telescoping members having a plurality of openings spaced apart of one another lengthwise of said one telescoping member, and a fixing pin insertable in a selected one of the openings to adjust the length of said one arm.

11. The safety arrangement as recited in claim 6, wherein each support structure has an upright post connected to the inner peripheral edge of the net to raise the elevation of the same.

12. The safety arrangement as recited in claim 6, wherein each support structure has at least one arm extending generally outwardly away from the outer face of the building in the fully deployed condition of the net, and wherein said one arm is pivotably mounted on the mounting means for freedom of angular movement about a pivot axis back toward the outer face of the building.

13. The safety arrangement as recited in claim 1, wherein the moving means includes a winch removably mounted at an overhead position on a respective guide rail, said winch having a depending cable which has a lower cable end operatively connected to the mounting means.

14. The safety arrangement as recited in claim 13, wherein the mounting means includes a higher and a lower movable member mounted on a respective guide rail for joint movement lengthwise of the latter, and wherein the lower cable end is detachably operatively connected to the lower movable member.

15. The safety arrangement as recited in claim 13, wherein the mounting means includes a higher and a lower movable member mounted on a respective guide rail for joint movement lengthwise of the latter, and wherein the lower cable end is detachably operatively connected to the higher movable member.

16. The safety arrangement as recited in claim 13, wherein the mounting means includes a higher and a lower movable member mounted on a respective guide rail for joint movement lengthwise of the latter, and wherein the lower cable end is detachably operatively connected to the higher and the lower movable members.

17. The safety arrangement as recited in claim 13, wherein the mounting means includes a higher and a lower movable member mounted on a respective guide rail for joint movement lengthwise of the latter, and an adjustable connecting arm extending between the higher and the lower movable members, said connecting arm having a pair of telescoping sections, one of the telescoping sections having a plurality of apertures spaced apart of one another lengthwise of said one telescoping section, and a connector pin insertable in a selected one of the apertures to adjust the length of said connecting arm.

18. The safety arrangement as recited in claim 13, wherein the winch includes a turnable crank and a winch member mounted for movement lengthwise of the respective guide rail, and further comprising means for locking the winch at a fixed elevation along the respective guide rail.

19. The safety arrangement as recited in claim 18, wherein each guide rail has a longitudinal channel, and a plurality of holes spaced apart of one another along a respective guide rail, and wherein the winch member is received in the channel for movement therealong, and wherein the locking means includes a locking winch pin insertable in a selected one of the holes below the winch member to fix the winch at the fixed elevation.

20. A method of safeguarding workmen and passersby from injury during the construction of multi-floor buildings, comprising the steps of:

(a) attaching a plurality of upright elongated guide rails to a building adjacent an outer face of the building;

(b) supporting opposite end regions of a safety net from a pair of support structures at the end regions to suspend the net in a fully deployed condition in which the safety net extends generally outwardly away from the outer face of the building over a predetermined distance;

(c) mounting the support structures on the guide rails for independent movement lengthwise along the guide rails; and (d) moving the support structures independently of each other and in alternate succession to different elevations along the guide rails while constantly maintaining the safety net in the fully deployed condition during such movement.

* * * * *